United States Patent [19]

Pfalzgraf et al.

[11] Patent Number: 4,823,751

[45] Date of Patent: Apr. 25, 1989

[54] CONTROL APPARATUS FOR AN INJECTION PUMP

[75] Inventors: Manfred Pfalzgraf; Bernward Stoll, both of Frankfurt am Main; Kurt Probst, Schwalbach; Heinz-Friedrich Ohm, Weiterstadt; Andreas Wokan, Darmstadt, all of Fed. Rep. of Germany

[73] Assignee: VDO Adolf Schindling AG, Frankfurt am Main, Fed. Rep. of Germany

[21] Appl. No.: 72,132

[22] Filed: Jul. 10, 1987

[30] Foreign Application Priority Data

Aug. 28, 1986 [DE] Fed. Rep. of Germany ..... 3629265

[51] Int. Cl.[4] ..... F02M 39/00

[52] U.S. Cl. ..... 123/359; 123/198 DB; 123/357

[58] Field of Search ..... 123/357, 358, 359, 198 D, 123/198 DB, 479

[56] References Cited

U.S. PATENT DOCUMENTS

| | | | |
|---|---|---|---|
| 3,693,603 | 9/1972 | Lewamczyk | 123/359 |
| 3,915,130 | 10/1975 | Hobo | 123/358 |
| 3,916,854 | 11/1975 | Barton | 123/357 |
| 4,150,654 | 4/1979 | Heitzman | 123/359 |
| 4,177,516 | 12/1979 | Mason | 123/358 |
| 4,497,294 | 2/1985 | Izumi | 123/357 |
| 4,690,114 | 9/1987 | Weischedel | 123/357 |

*Primary Examiner*—Carl Stuart Miller

*Attorney, Agent, or Firm*—Martin A. Farber

[57] ABSTRACT

In an apparatus operable with an injection pump of a diesel motor whereby the injection pump has an output setting element and a shut-off element, the output setting element is controllable by a digital control device. Also, the shut-off element is pulsatingly controllable by the digital control device such that a predetermined rotational speed of the diesel motor is achieved.

13 Claims, 1 Drawing Sheet

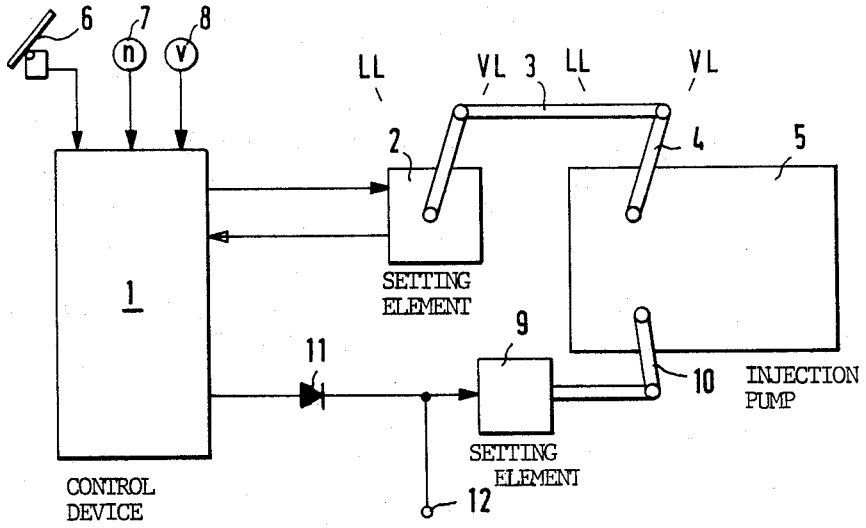
6
7
8
n
V
LL
VL
3
LL
VL
2
4
5
1
SETTING ELEMENT
9
11
10
INJECTION PUMP
SETTING ELEMENT
CONTROL DEVICE
12

CONTROL APPARATUS FOR AN INJECTION PUMP

FIELD AND BACKGROUND OF THE INVENTION

The invention relates to control apparatus for an injection pump of a diesel motor, whereby the injection pump has a power setting element and a shut-off element, whereby further, the output setting element is regulatable by a digital control device.

Considering the control of output elements of injection pumps with the help of digital control devices in situations wherein a fault is present, for example with a jamming in the load position, there is provided an emergency stop function in known systems for avoiding critical operating conditions. In addition a shut-off element, located also on the injection pump, is actuated.

By turning off the motor, however, the critical operating condition is not eliminated, but rather by a resulting failure of servo and auxiliary devices, further critical conditions occur.

SUMMARY OF THE INVENTION

It is an objective of the invention to deal with a defect in the area of control of the output setting element of an injection pump to make it possible for the motor to run further with a non-critical rotational speed.

In accordance with the invention there is provided a control apparatus wherein a shut-off element (10) is pulsatingly regulatable by a digital control device (1) such that a predetermined rotational speed of the diesel motor is achieved.

In accordance with a further feature of the invention the digital control device and the shut-off element (10) form a two point controller. In this manner it is possible in a simple manner to maintain the predetermined rotational speed value to the required precision.

Instead of the two-point controller, also by using a suitable positioning member and by a suitable cycle frequency, a linear setting behavior can be achieved. In addition the shut-off element can be constructed in connection with a coordinated setting element such that with sufficiently high cycle frequency, a rotational speed is obtained from the average or mean value of the pulses.

Another feature of the invention is that the pulsating control of the shut-off element (10) is releasable by a defect with a regulating of the output setting element. In this manner, automatically, for the case of a defect inside of the apparatus, which apparatus is formed by the digital control device and the output setting element, the rotational speed of the motor is reduced to a non-critical value.

The apparatus of the invention however can be expanded in the manner that the pulsing regulation of the shut-off element (10) is releasable upon exceeding of the permissable service operating conditions. In this way, even without the occurrence of an error in the digital control device or with the output setting element, a limitation of the motor output speed takes place, for example to maximum speed of the vehicle or respective maximum rotational speed.

Further according to a feature of the invention, a device (11) for connection of a signal, emitted by the digital control device (1), with a signal provided further for turning off the diesel motor, is connected between an output, provided for the shut-off element (10), of the digital control device (1) and the shut-off element (10). In this manner a turning off of the motor independently of the digital control device is possible at any time.

Further, according to the invention it is possible to store various predetermined rotational speeds in the digital control device (1), to which rotational speeds the motor is controlled, depending upon the type of the existing defect or depending on other circumstances.

The invention permits of numerous embodiments.

BRIEF DESCRIPTION OF THE DRAWING

With the above and other objects and advantages in view, the present invention will become more clearly understood in connection with the detailed description of a preferred embodiment, when considered with the accompanying drawing, of which:

the only figure is a schematic illustration of the device of the present invention.

DETAILED DESCRIPTION OF THE PREFERRED EMBODIMENT

Referring to the drawing, a digital control device 1 is connected with a setting element 2 which is a per se known manner comprises an electric motor with a following transmission. By means of rods or a linkage 3, the setting element 2 is connected to the output setting element 4 of an injection pump 5 of a diesel motor (not illustrated). The setting range of the setting member 2 and of the output setting element 4 extends between LL=idling and VL=full load.

To the digital control device there is fed a desired value for the motor output by a gas pedal 6. Furthermore the digital control device is connected to a transmitter 7, 8 for the rotational speed n and the vehicular speed v.

In the per se known digital control device 1, now by corresponding programming or circuitry, devices are provided which permit recognition of an error inside a control circuit. As soon as such an error occurs, the shut-off mechanism 10 of the injection pump 5 is actuated via a further setting element 9 for turning off the motor. However, as soon as the rotational speed n falls under a predetermined value, the shut-off mechanism is further opened via the setting member 9. In this manner a rotational speed corresponding to the prescribed allowed speed is adjusted.

The drawing shows that with the aid of a diode 11, the signal fed from the digital control device 1 to the setting member 9 can be applied with a further signal fed at 12, whereby the signal fed at 12 has priority. In this manner it is possible, without consideration on the digital control device as well as possibly error operating functions to the same, to turn off the motor.

As already mentioned above, the apparatus in accordance with the present invention can also be used for limiting the rotational speed of the motor or velocity. In addition a correspondingly changed or completed program is to be provided in the digital control device so that the shut-off mechanism 10 is actuated, not only upon a defect, but also in normal service upon exceeding the permissable operating conditions, for example the permissable speed.

While there has been disclosed one embodiment of the invention, it is to be understood that this embodiment is provided by example only and not in a limiting sense.

We claim:

1. An apparatus operable with an injection pump of a diesel motor, wherein the injection pump has a power output setting element and a fuel shut-off element, each of said elements comprising a mechanical actuator, and wherein further the output setting element is regulatable by a digital control device, the apparatus further comprising the digital control device; and wherein the shut-off element is pulsatingly controllable from the digital control device to attain a predetermined rotational speed of the diesel motor; pulsating control by the digital control device being operative, upon indication of defect in control of the output setting element, to command the shut-off element to shut off the motor until motor rotation drops below a predetermined value of rotation, after which drop in motor rotation the digital control device commands the shut-off element to admit sufficient fuel to maintain a reduced speed of motor rotation.

2. The apparatus according to claim 1, wherein the digital control device and the shut-off element form a two point controller.

3. The apparatus according to claim 1, further comprising a positioning member operable with a suitable engine cycle frequency for achieving a linear setting behavior.

4. The apparatus according to claim 1, wherein the pulsating control of the shut-off element is releasable by a defect with a control of the output setting element.

5. The apparatus according to claim 1, wherein the pulsating control of the shut-off element is releasable upon exceeding of operating conditions.

6. The apparatus according to claim 1, further comprising means for connecting a signal, emitted by the digital control device, with a signal provided further for turning off the diesel motor, said connecting means being connected between the shut-off element and an output, provided for the shut-off element, of the digital control device.

7. The apparatus according to claim 1, wherein the digital control device stores various predetermined rotational speeds, to which rotational speeds the motor is controlled, depending upon the type of an existing defect.

8. A failsafe apparatus operable with an injection pump of a diesel motor, wherein the injection pump has an output setting element and a shut-off element, each of said elements comprising a mechanical actuator, the apparatus further comprising a digital control device, and wherein the output setting element is regulatable by the digital control device;

in case of a failure of the output setting element, the output setting element is releasable from the digital control device; and the shut-off element is pulsatingly controllable from the digital control device to attain a predetermined rotational speed of the diesel motor.

9. The apparatus according to claim 8, wherein the digital control device and the shut-off element form a two point controller.

10. The apparatus according to claim 8, further comprising a positioning member operable with a suitable engine cycle frequency for achieving a linear setting behavior.

11. The apparatus according to claim 8, wherein the pulsating control of the shut-off element is releasable upon exceeding of operating conditions.

12. The apparatus according to claim 8, further comprising means for connecting a signal, emitted by the digital control device, with a signal provided further for turning off the diesel motor, said connecting means being connected between the shut-off element and an output, provided for the shut-off element, of the digital control device.

13. The apparatus according to claim 8, wherein the digital control device stores various predetermined rotational speeds, to which rotational speeds the motor is controlled, depending upon the type of an existing defect or failure.

* * * * *